United States Patent [19]

Hillerström

[11] Patent Number: 4,645,001

[45] Date of Patent: Feb. 24, 1987

[54] HEAT EXCHANGER

[75] Inventor: Björn I. Hillerström, Onsala, Sweden

[73] Assignee: ArmaturJonsson AB, Vastra Frolunda, Sweden

[21] Appl. No.: 735,559

[22] Filed: May 17, 1985

[30] Foreign Application Priority Data

May 24, 1984 [SE] Sweden ..... 8402808

[51] Int. Cl.[4] ..... F28D 7/00

[52] U.S. Cl. ..... 165/159; 165/908

[58] Field of Search ..... 165/159, 163, DIG. 11

[56] References Cited

U.S. PATENT DOCUMENTS

| | | | |
|---|---|---|---|
| 427,397 | 5/1890 | Campbell | 165/110 |
| 970,050 | 9/1910 | Hiller | 165/116 |
| 1,662,143 | 3/1928 | Braun | 165/159 |
| 1,964,256 | 6/1934 | Fahrenwald | 165/163 X |
| 3,885,622 | 5/1975 | McLain | 165/179 |
| 4,230,173 | 10/1980 | Eastman et al. | 165/909 X |

*Primary Examiner*—Albert W. Davis, Jr.
*Assistant Examiner*—Peggy A. Neils
*Attorney, Agent, or Firm*—Burgess, Ryan & Wayne

[57] ABSTRACT

A heat exchanger comprises a shell having an inlet and an outlet for a first medium, and at least one tube coil disposed in the shell and having straight, substantially parallel coil legs, and an inlet and an outlet for a second medium for exchanging heat with the first medium. Distribution plates with spray holes are disposed in the shell in front of each coil leg at a distance from the center axis thereof which is not more than about 10 times the diameter of the spray holes.

6 Claims, 6 Drawing Figures

HEAT EXCHANGER

The present invention relates to a heat exchanger comprising a shell with an inlet and an outlet for a first medium, and at least one tube coil having substantially straight parallel coil legs and turns adjacent opposite shell walls, and an inlet and an outlet for a second medium for exchanging heat with said first medium.

A common problem encountered in most types of heat exchangers is that an uneven heat distribution often occurs. Such an uneven heat distribution may be regarded as a kind of by-pass where the heat exchange surfaces are not optimally used. The object of this invention is to provide a heat exchanger where the risk of such an uneven heat distribution is obviated or, at any rate, considerably reduced. Another object of the invention is to arrange the heat exchange surfaces in a manner to considerably improve the exchange of heat.

According to the invention, these objects are achieved in that a distribution plate provided with spray holes and having a dimension corresponding to the internal cross-sectional area of the shell parallel to the coil legs is disposed in front of each coil leg as counted in the direction of flow of said first medium.

Suitably, a plurality of tube coils are connected in parallel and arranged in the shell with the coil legs disposed parallel to and adjacent each other, the tube coils consisting of oval tubes placed with the larger cross-sectional dimension parallel to the direction of flow of said first medium.

The invention will be described in more detail hereinbelow with reference to the accompanying drawings which schematically illustrate embodiments of the invention.

Figure 1:
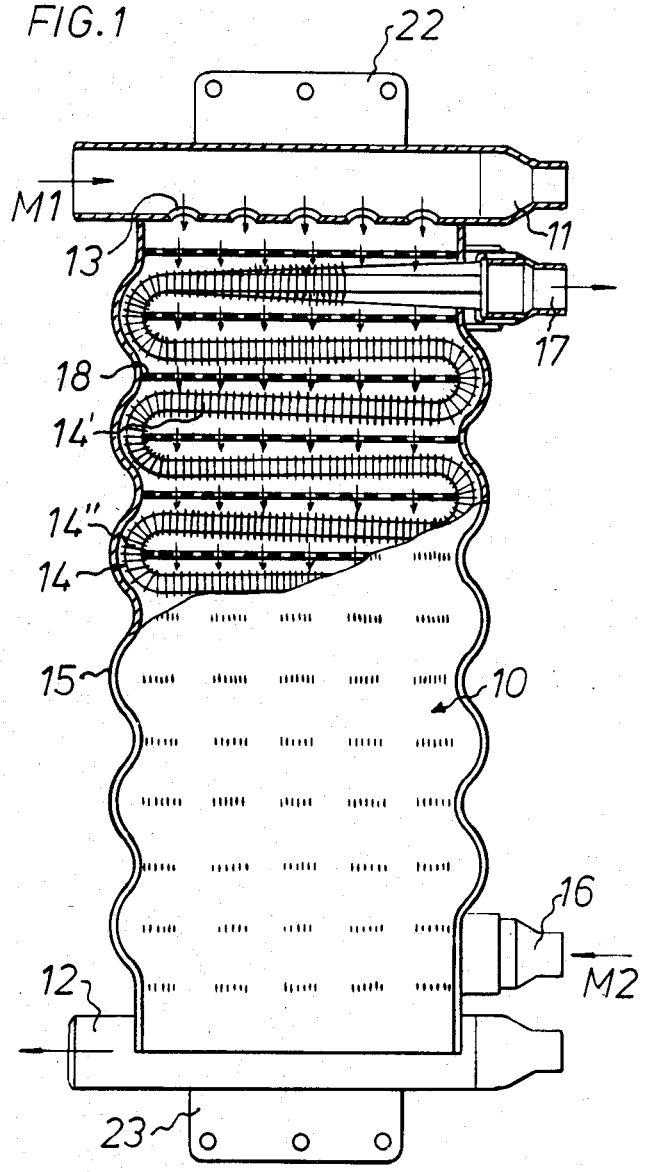
FIG. 1 is a side view partly in section of a simple design of a heat exchanger according to the invention.

FIG. 1 illustrates an embodiment of the invention comprising an elongate shell 10 in the form of a box with planar flat sides, undulatory side walls and rectangular cross-section. The box is closed at the top by an inlet pipe 11 for a medium M1 and at the bottom by an outlet pipe 12 for said medium. A suspension plate 22 is connected to the inlet pipe 11 and a similar plate 23 is connected to the outlet pipe 12. By means of these plates, the heat exchanger can be fixed e.g. on a wall or a frame structure. On its side facing the interior of the shell, the inlet pipe 11 has openings 13 with a relatively large diameter. The medium M1 is supplied through the pipe 11 and from there passes into the shell 10 through the openings 13, as illustrated by arrows. In its surface facing the interior of the shell 10, the pipe 12 has corresponding openings and the medium leaves through the outer pipe 12 as indicated by an arrow. The inlet pipe 11 and the outlet pipe 12 have a narrower section at their right-hand ends. To these narrower ends it is possible to connect e.g. a thermostat or a venting device or, at the bottom, a drain valve.

A tube coil 14 is anchored to the shell 10. This tube coil consists of a serpentine tube, for instance a copper tube provided with fins. As appears, the tube coil has straight legs 14' which are interconnected by means of turns 14''. The coil legs interconnected by the same turn 14'' slightly converge in a direction away from the turn, as illustrated in FIG. 1, but may also extend in parallel, as shown e.g. in FIG. 5. The coil legs may also be sinusoidal, in which case the general directions are parallel. The turns 14'' are disposed in the bulging portions 15 of the undulatory walls. To provide for said convergence of the coil legs, the portions 15 are slightly offset with respect to each other. A second medium M2 is supplied to the coil through an inlet 16 and leaves the coil through an outlet 17, as illustrated by arrows. As shown, the coil tube has a considerably smaller diameter than the connections 16, 17 which, for this reason, are provided with a reducing portion. The heat exchanger now described operates according to the counterflow principle.

Figure 3:
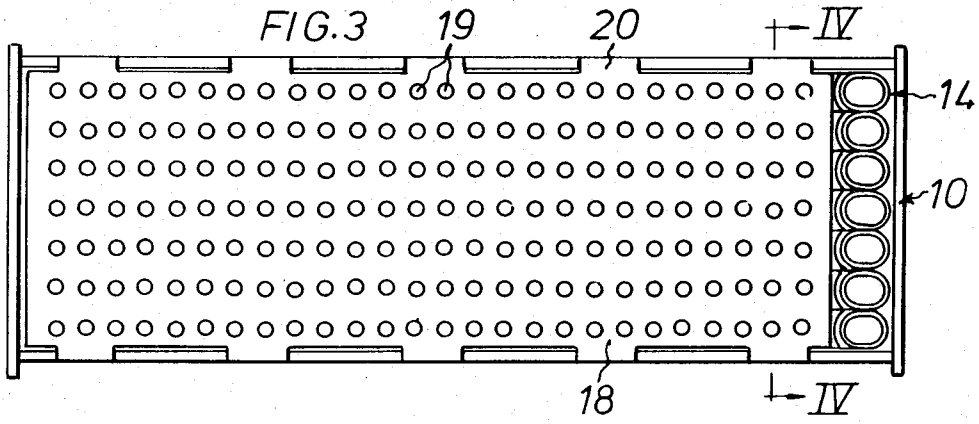
FIG. 3 is a sectional view from above of a modified embodiment of the heat exchanger according to the invention with a plurality of heating coils connected in parallel.

Upstream of each coil leg 14', as counted in the direction of flow of the medium M1 through the shell 10, there is mounted a distribution plate 18. According to FIG. 1, the plates 18 are fixed alternatively in the two opposite undulatory side walls of the shell on the inside of the wave troughs thereof and extend across the shell 10 up to the turns of the tube coil where they are designed with a recess or a hole through which the turn extends. The distribution plates are so dimensioned that they fill substantially the entire cross-sectional area of the shell, as illustrated in FIG. 3, which illustrates a method of anchoring the plates to the shell by means of lugs 20 extending into openings in the shell. As also shown in FIG. 3, the plates are provided with a large number of spray holes 19 which may be circular, as is illustrated, oblong or have any other suitable cross-sectional shape. Of decisive importance in this context is the distance between the plates 18 and a transverse plane along the center line of the coil legs, 14' said distance suitably being not more than about 10 times the diameter of the spray holes.

The heat exchanger described above operates in the following manner.

Conduits for the two media M1 and M2 between which heat exchange should take place are connected to the inlet pipe 11 and outlet pipe 12 and the inlet pipe 16 and outlet pipe 17, respectively. The medium M2 thus flows through the tube 14 while the medium M1 flows through the pipe 11 into the shell through the openings 13 and is evenly distributed across the width of the shell 10, as illustrated in FIG. 1. When the medium M1 has emerged from the openings 13, it encounters the first distribution plate 18 with the spray holes 19. The medium emerges from the spray holes 19 as a downwardly diverging jet and, because of the location of the distribution plate at a distance from the center line of the coil legs which is not more than about 10 times the diameter of the spray holes, the medium will "enclose" the coil leg in an extremely advantageous manner, which optimizes the heat exchange. The spacing between the spray holes 19 in the plates 18 is such that the medium jets emerging from the spray holes will interfere with or contact each other in the upper boundary plane of the coil legs. When the medium M1 has passed the first coil leg, it encounters the next distribution plate 18 which is designed and positioned in the same manner as the first plate for distributing the medium over the subjacent coil leg, and so forth. In FIG. 1, twelve coil legs with distribution plates are provided, one row of spray holes 19 being disposed over each coil leg 14'.

Figure 4:
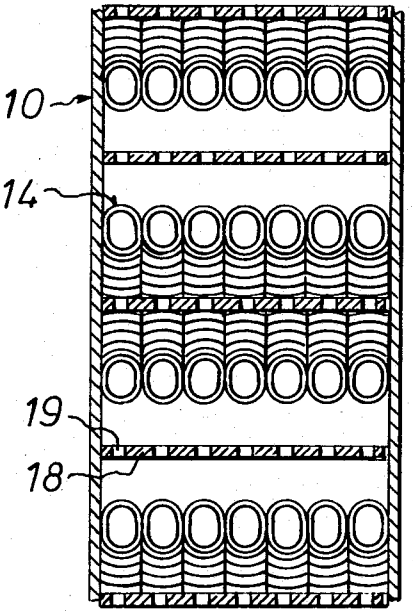
FIG. 4 illustrates a portion of a vertical section along the line IV—IV in FIG. 3.
Figure 2:
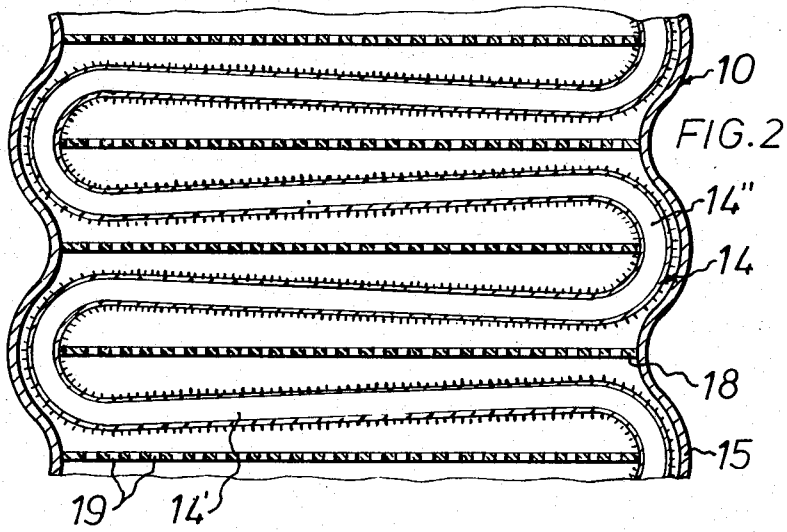
FIG. 2 is a sectional view of a portion of the heat exchanger shell and a tube coil mounted therein.

The heat exchanger in FIG. 1 has one tube 14, which is often sufficient, but where larger capacities are desired, a plurality of tubes, as illustrated in FIGS. 3 and 4, are preferably connected in parallel. These tubes are disposed with the coil legs parallel and adjacent each other and, as in the foregoing embodiment, distribution plates with spray holes 19 in a number of rows corresponding to the number of tubes (FIG. 3) are disposed over the coil legs. The plates 18 are fixed in the shell 10 by means of rectangular lugs 20 projecting from the edges of the long sides and mounted in mating openings in the flat sides of the shell 10. The lugs 20 can be sealed in the holes in any suitable manner, e.g. by soldering, gluing or welding. Because of the fins, sufficient space will be obtained between adjacent tubes connected in parallel for allowing the flowing medium M1 to pass through.

Figure 6:
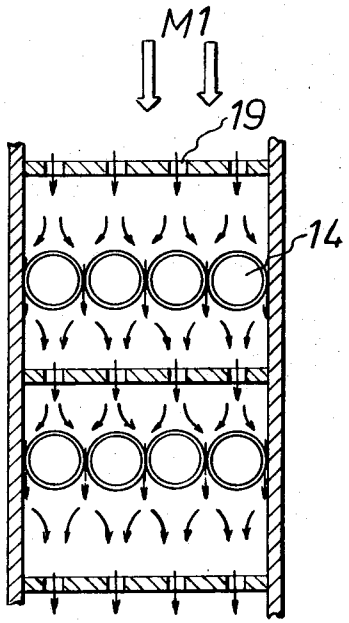

The flow of the medium M1 through a heat exchanger with several parallel tubes 14 is illustrated in more detail in FIG. 6.

Figure 5:
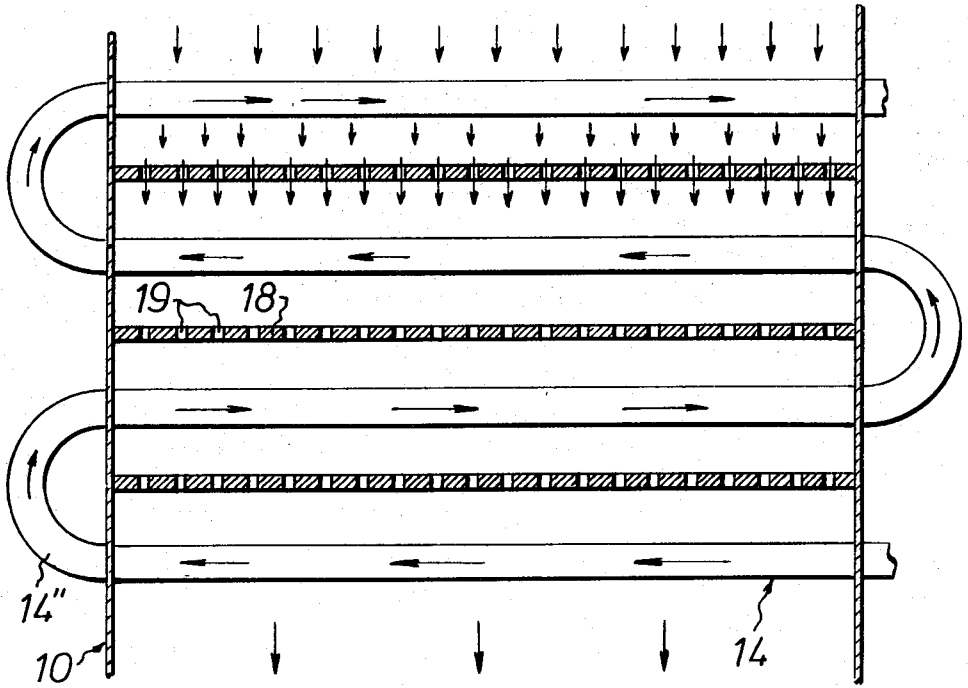
FIG. 5 illustrates another embodiment of the heat exchanger according to the invention, and FIG. 6, on a larger scale, shows the medium flow through the heat exchanger.

In the two preceding embodiments, the plates 18 are tightly connected to the flat sides of the shell and alternatively extend up to either side wall, as previously described. According to FIG. 3, the plates extend up to a point at a certain distance from the inner sides of the turns of the tube coil. The idea of such a construction is as follows. When the tube 14 expands upon heating, the outer sides of the turns 14'' will be tightly pressed against the inner sides of the bulging portions 15 throughout a predetermined distance. As a result, the part of the medium M1 which is flowing down along the portions 15 will be prevented from descending further at this point of contact and said part of the medium M1 will instead be forced sideways to pass around the tube and descend through the gap between the end of the plate 18 and the inner sides of the turns. This passage of liquid around the turns is acceptable and even desirable in many cases. It may however also be desirable to completely separate the coil legs 14' from each other by means of the plates 18. As shown in FIG. 5, this may be achieved in that the tube coil 14 adjacent its turns passes through the shell 10 with the turns 14'' on the outside of the shell. In this manner, the plates 18 can be sealingly connected to the inner side of the shell 10 throughout their entire circumference. Although not shown in FIG. 5, an outer shell is of course disposed around the shell 10.

What I claim and desire to secure by letters patent is:

1. A heat exchanger comprising:

a shell with an inlet and an outlet for a first medium, a plurality of tube coils in said shell, adjacent ones of said tube coils being substantially in contact with each other, each said tube coil having substantially parallel coil legs and turns adjacent opposite shell walls, and an outlet for a second medium for exchanging heat with said first medium, and a plurality of distribution plates, each said distribution plate having a plurality of spray holes and a dimension corresponding to the internal cross-sectional area of the shell parallel to said coil legs, each of said plates being located at a predetermined distance in front of each respective coil leg of said plurality of tube coils as counted in the direction of flow of said first medium, and said spray holes in each plate being separated into rows, with each row being positioned in line with, and directly in front of, a coil leg of one of said tube coils.

2. Heat exchanger as claimed in claim 1, wherein said distribution plates are disposed in front of the center axis of each coil leg at a distance therefrom not more than about 10 times the diameter of the spray holes.

3. Heat exchanger as claimed in claim 1, wherein the spacings between the spray holes of the distribution plates are so selected that the jet of medium emerging from each spray hole and diverging in a direction toward the coil leg will encounter the jets from adjacent spray holes approximately in the plane of the boundary surface of the coil leg located in front of said spray holes and facing them.

4. Heat exchanger as claimed in claim 1, 2 or 3, wherein a plurality of tube coils are connected in parallel and arranged in the shell with the coil legs disposed parallel to and adjacent each other.

5. Heat exchanger as claimed in claim 1, wherein the turns of the tube coil are disposed on the outer side of the shell walls.

6. Heat exchanger as claimed in claim 1, wherein the tube coil comprises an oval, finned tube disposed with its larger cross-sectional dimension parallel to the direction of flow of said first medium.

* * * * *